United States Patent [19]

Dudley et al.

[11] 3,980,920

[45] Sept. 14, 1976

[54] MULTI-RESONATOR MICROWAVE OSCILLATOR

[75] Inventors: Kenneth W. Dudley, Sudbury; George H. MacMaster, Lexington; Lawrence J. Nichols, Burlington, all of Mass.

[73] Assignee: Raytheon Company, Lexington, Mass.

[22] Filed: July 2, 1975

[21] Appl. No.: 592,590

[52] U.S. Cl. ..... 315/39.3; 313/103 R; 315/5.11; 315/3.6; 331/82; 331/89

[51] Int. Cl.[2] ..... H01J 25/34

[58] Field of Search ..... 315/3.6, 39.3, 5.11, 315/5.12; 313/103, 104, 105; 331/82, 89

[56] References Cited

UNITED STATES PATENTS

| | | | |
|---|---|---|---|
| 2,498,267 | 2/1950 | Hansell | 313/103 X |
| 2,535,137 | 12/1950 | Jervis | 313/105 X |
| 2,819,449 | 1/1958 | Herold | 315/39.3 X |
| 3,069,594 | 12/1962 | Feinstein | 315/39.3 |
| 3,123,735 | 3/1964 | Hull | 315/3.6 |
| 3,255,422 | 6/1966 | Feinstein et al. | 315/39.3 X |
| 3,508,110 | 4/1970 | Farney | 315/3.6 X |
| 3,750,043 | 7/1973 | Edsztein | 315/5.12 |

*Primary Examiner*—Saxfield Chatmon, Jr.
*Attorney, Agent, or Firm*—Edgar O. Rost; Milton D. Bartlett; Joseph D. Pannone

[57] ABSTRACT

A microwave oscillator is provided having electron emissive means and a first surrounding resonant structure. The first structure is fabricated of a material capable of emitting secondary electrons. A second resonant structure surrounds the secondary electron emitter and microwave energy is generated by the interaction between the electrons and currents induced in the structure. The high degree of isolation between the first oscillator section and the second amplifying section results in the generation of stable oscillations relatively free of effects of load variations.

3 Claims, 2 Drawing Figures

MULTI-RESONATOR MICROWAVE OSCILLATOR

BACKGROUND OF THE INVENTION

1. Field of the Invention

The invention relates to crossed-field microwave oscillator devices.

2. Description of the Prior Art

Microwave frequency energy has been generated by oscillators such as the magnetron as well as other crossed-field devices. Typically an electron emitter and a surrounding resonant energy propagating structure such as an interdigital delay line or cavity resonators provides for a revolving spoke-like space charge and the inducing of RF currents in the resonant structure. Load mismatches must be considered in all such devices to establish stable oscillation frequencies. Mismatches cause frequencies to shift due to frequency pulling and it is difficult to maintain oscillations within established bandwidths which are either required for a particular use or are government regulated.

In the past, external stabilizing cavities have been utilized in an attempt to achieve stable oscillation frequencies. In addition, isolators and circulators have been utilized to cope with load mismatches, however such devices increase the expense and introduce losses.

A need exists in the microwave field for improved means for generating oscillations which are highly stable with a minimum of interference arising from the load.

SUMMARY OF THE INVENTION

In accordance with the teachings of the present invention, a high power, very stable microwave oscillator is provided. A first electron emissive means which may be a heated cathode or a cold cathode emits electrons which interact with a first resonant energy propagating structure surrounding the cathode emitter. Oscillations are established and the rotating spokes induce currents in the first resonant structure. The first resonant structure which forms the anode for the oscillator section is fabricated of a material having a secondary electron emission capability such as platinum. The RF induced currents on the first resonant structure results in the generation of oscillations as a result of the rotating space charge in this section. A second resonant energy propagating structure surrounds the first resonant structure with the first structure functioning as a cathode while the second structure forms the anode of an amplifier section. The rotating spokes generated in the oscillator section will result in a second rotating space charge in the amplifier section. Hence, the first oscillator section has as a load the rotating space charge in the second or amplifier section.

As the result of the disclosed structure a high degree of isolation exists between the oscillator circuit section and the amplifying circuit section which is connected to the external load. Isolation between the respective sections can be as high as 60 db which results in very stable oscillations. A high gain also is feasible because of the high isolation and values in the order of 30–40 db will be possible. The output from the second resonant structure is terminated by such means as a water load or dry load dependent on the reverse power to be absorbed. Expensive isolators and/or circulators will not be required. The oscillator will operate substantially independent of load variations.

BRIEF DESCRIPTION OF THE DRAWINGS

Details of the invention will be readily understood after consideration of the following description of an illustrative embodiment and reference to the accompanying drawings, wherein.

DESCRIPTION OF THE PREFERRED EMBODIMENT

Figure 1:
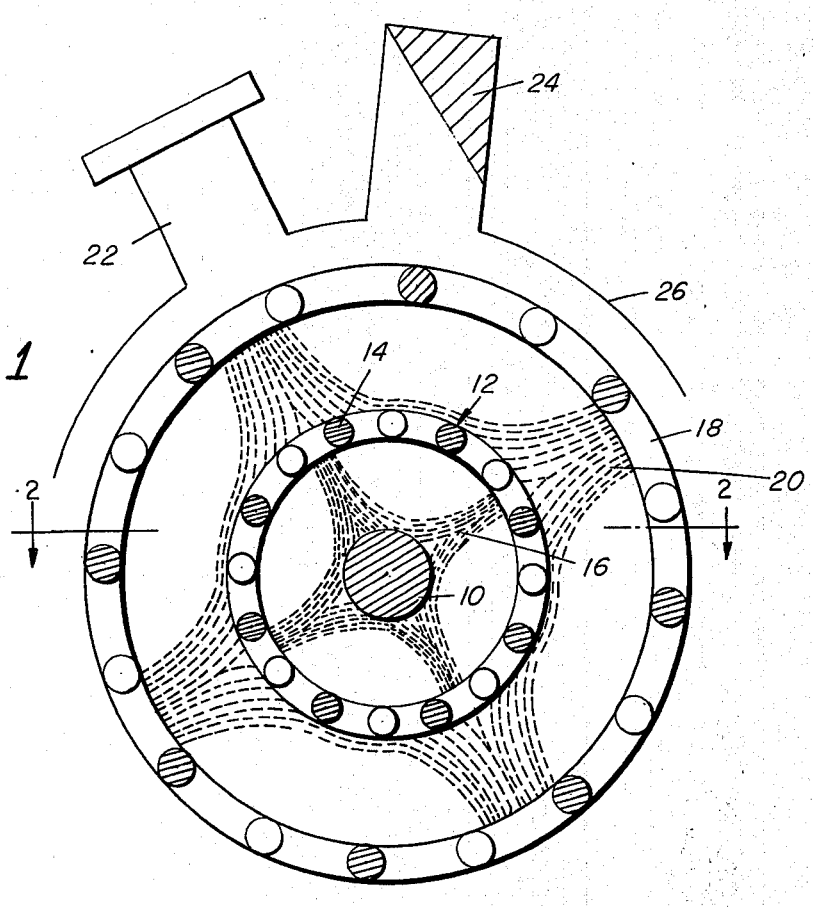
FIG. 1 is a diagrammatic representation of an illustrative embodiment of the invention.
Figure 2:
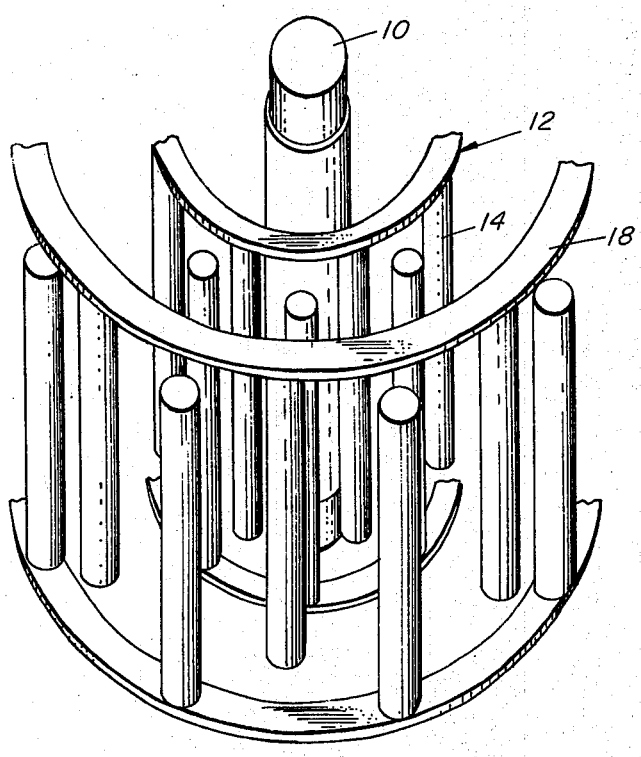
FIG. 2 is an isometric view taken along the line 2—2 in FIG. 1.

Referring to the drawings, first electron emissive means 10 are provided. A heated cathode cylinder is preferred although a cold cathode may be employed with a suitable RF drive. Surrounding the cathode 10 is a resonant structure such as a slow wave interdigital delay line 12 comprising interleaved members 14.

An electric field is established between the cathode emitter and the first resonant structure. The electrons emitted interact with the first resonant structure to result in a revolving space charge 16 which induces RF current to flow along the first resonant structure 12. The magnetic fields are disposed parallel to the axis of the cathode 10 and perpendicular to the electric fields to result in a crossed field device. The revolving space charge will result in the oscillations being established on the first resonant structure 12. This section of the overall device will be referred to as the oscillator section.

In accordance with the teachings of the invention, the first resonant structure which forms an anode in the oscillator section also functions as a cathode for a following amplifying section. The first resonant structure 12 has been shown as an interdigital delay line and may be fabricated of a material having a secondary electron emission ratio in excess of one such as, for example, platinum. This structure becomes a cold cathode for the subsequent section. Surrounding the first resonant structure is a second such structure which also may be an interdigital delay line 18 which becomes the anode for the amplifying section. This structure may be fabricated of oxygen-free copper. A second revolving space charge 20 induces an RF current along the delay line 18. An output coupling means 22 terminates the delay line 18 and a matched load 24 such as a dry or water load may also be provided.

Since the oscillator section and the amplifier section are coupled solely by the electron space charge, a high degree of isolation exists between these components. Further, a high gain is feasible in the amplifying section and values as high as 30–40 db may be realized. The voltages established between the cathode emitter and the first resonant structure results in the latter being positive with respect to the cathode. As a result, the space charge is established which rotates and induces the currents on the first resonant structure. The surrounding second resonant structure is biased at a higher electrical potential so that it is positive with respect to the first resonant structure. This first resonant structure, therefore, which forms the anode for the oscillator section becomes the cathode for the amplifying section.

The disclosed structures are housed within a vacuum envelope which is indicated diagrammatically by the numeral 26. The envelope is evacuated in the manner well-known in the microwave tube art. Further, while an interdigital delay line type of energy propagating structure has been illustrated, similar structures may be substituted such as a strap and bar arrangement or cavity resonators. The foregoing description of the invention is to be interpreted broadly and not in a limiting sense.

We claim:

1. A microwave oscillator comprising:

means for emitting electrons;

first reentrant resonant means spaced from and concentric said electron emitting means and adapted to generate oscillations at a predetermined microwave frequency;

said first resonant means being fabricated of a material capable of emitting secondary electrons in response to impingement of said electrons thereon;

a second resonant means spaced from and concentric with said first resonant means and interacting with said secondary electrons to generate microwave frequency oscillations; and means for coupling said microwave energy from said second resonant means.

2. A microwave oscillator comprising:

means for emitting electrons;

a first reentrant resonant energy propagating structure surrounding said electron emitting means to interact in energy exchanging relationship with said electrons in the presence of an electric field between said electron emitting means and said first energy propagating structure and a magnetic field having a component transverse to said electric field to generate microwave frequency oscillations;

a second resonant energy propagating structure surrounding said first structure;

said first structure being fabricated of a material having a secondary electron emission ratio in excess of one at electron velocities producing microwave oscillation in said first resonator structure;

said second structure interacting in energy exchanging relationship with the secondary electrons; and means for coupling microwave energy from said second structure.

3. An oscillator according to claim 2 wherein said first and second resonant structures comprise a slow wave interdigital delay line.

* * * * *

UNITED STATES PATENT OFFICE

CERTIFICATE OF CORRECTION

Patent No. 3,980,920 Dated September 14, 1976

Inventor(s) Kenneth W. Dudley, George H. MacMaster and Lawrence J. Nichols

It is certified that error appears in the above-identified patent and that said Letters Patent are hereby corrected as shown below:

Column 2, line 24, change "current" to -- currents --;

Column 3, line 11, Claim 1, before "said" insert - - with-.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*